US008504187B2

(12) United States Patent
Sekine

(10) Patent No.: US 8,504,187 B2
(45) Date of Patent: Aug. 6, 2013

(54) EMBROIDERY DATA CREATION APPARATUS AND COMPUTER PROGRAM PRODUCT

(75) Inventor: Kiyokazu Sekine, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 43 days.

(21) Appl. No.: 13/274,891

(22) Filed: Oct. 17, 2011

(65) Prior Publication Data

US 2012/0111249 A1 May 10, 2012

(30) Foreign Application Priority Data

Nov. 9, 2010 (JP) ..... 2010-250377

(51) Int. Cl.
*D05C 5/02* (2006.01)

(52) U.S. Cl.
USPC ..... 700/138

(58) Field of Classification Search
USPC ..... 700/136, 137, 138; 112/475.18, 112/475.19
See application file for complete search history.

(56) References Cited

U.S. PATENT DOCUMENTS

| | | | | | |
|---|---|---|---|---|---|
| 4,964,352 | A | * | 10/1990 | Yokoe et al. | 112/103 |
| 5,227,976 | A | | 7/1993 | Hayakawa | |
| 5,563,795 | A | * | 10/1996 | Futamura et al. | 700/138 |
| 5,740,056 | A | * | 4/1998 | Futamura | 700/138 |
| 5,748,480 | A | * | 5/1998 | Mizuno | 700/138 |
| 5,927,220 | A | * | 7/1999 | Zheng et al. | 112/102.5 |
| 7,359,760 | B2 | * | 4/2008 | Kishi et al. | 700/138 |
| 7,542,822 | B2 | * | 6/2009 | Kawaguchi et al. | 700/138 |
| 2008/0017090 | A1 | | 1/2008 | Tashiro | |

FOREIGN PATENT DOCUMENTS

| | | |
|---|---|---|
| JP | A-58-198378 | 11/1983 |
| JP | A-63-125284 | 5/1988 |
| JP | A-3-75085 | 3/1991 |
| JP | A-4-261699 | 9/1992 |
| JP | A-11-123289 | 5/1999 |
| JP | B2-3063100 | 7/2000 |
| JP | A-2008-22992 | 2/2008 |

* cited by examiner

*Primary Examiner* — Danny Worrell
(74) *Attorney, Agent, or Firm* — Oliff & Berridge, PLC

(57) ABSTRACT

An embroidery data creation apparatus includes an outline data acquisition portion, a thread density data acquisition portion, a needle drop point setting portion that sets a plurality of first needle drop points, a plurality of second needle drop points, and a sewing order to alternately connect the plurality of first needle drop points and the plurality of second needle drop points using the stitches, a needle drop point change portion that, in a case where one of a value of a length ratio and a length difference is equal to or more than a specified threshold value, changes positions of some of the plurality of second needle drop points, respectively, to positions each of which will be covered by a stitch formed by connecting a first stitch end point and a second stitch end point, and an embroidery data creation portion that creates embroidery data.

10 Claims, 10 Drawing Sheets

FIG. 3

157

| LENGTH OF FIRST LINE SEGMENT/ LENGTH OF SECOND LINE SEGMENT | CHANGE FREQUENCY (m) |
|---|---|
| 1.5 OR MORE AND LESS THAN 2.5 | 3 |
| 2.5 OR MORE | 2 |

FIG. 4

158

| THREAD DENSITY | CORRECTION COEFFICIENT (X) |
|---|---|
| LESS THAN 3.5 STITCHES/mm | 0.8 |
| 3.5 STITCHES/mm OR MORE AND LESS THAN 4.5 STITCHES/mm | 0.7 |
| 4.5 STITCHES/mm OR MORE | 0.6 |

EMBROIDERY DATA CREATION APPARATUS AND COMPUTER PROGRAM PRODUCT

CROSS-REFERENCE TO RELATED APPLICATION

This application claims priority to Japanese Patent Application No, 2010-250377, filed Nov. 9, 2010, the content of which is hereby incorporated herein by reference in its entirety.

BACKGROUND

The present disclosure relates to an embroidery data creation apparatus and a computer program product that create embroidery data to perform embroidery sewing using a sewing machine capable of embroidery sewing.

A sewing machine capable of embroidery sewing performs embroidery sewing while relatively moving a work cloth and a sewing needle based on embroidery data that specifies coordinates of needle drop points. For example, an embroidery data creation apparatus is known that can create embroidery data for each of blocks that form an embroidery pattern. The block herein means a closed area that has a triangular shape, a rectangular shape, a fan-like shape or the like. Based on data of an outline and thread density of the block, this type of embroidery data creation apparatus creates embroidery data to perform embroidery sewing such that the block is filled with stitches by alternately connecting a pair of line segments that are included in the outline and that face each other.

However, in a case where lengths of the pair of line segments are significantly different from each other, if all the needle drop points are set on the pair of line segments, there may be a case in which the needle drop points are densely arranged on a shorter line segment of the pair of line segments. As a result, the appearance of the embroidery pattern may be disfigured. Also, thread breakage or needle breakage may occur. To address this, a needle drop data creation apparatus is known in which a return line is virtually arranged between the pair of line segments and some of the needle drop points on the shorter line segment are set on the return line as middle drop points.

SUMMARY

In a case where embroidery sewing is performed based on needle drop data created by the above-described needle drop data creation apparatus, it may be possible to avoid concentration of the needle drop points on the shorter line segment. However, while ends of stitches on the longer line segment side are aligned on the longer line segment, ends of stitches on the facing shorter line segment side are not arranged in a line, because the middle drop points are set on the return line. As a result, in a case where stitches to fill the block are formed, the stitches may not look beautiful as a whole.

Various embodiments of the broad principles derived herein provide an embroidery data creation apparatus and a computer program product that are capable of creating embroidery data that can obtain an embroidery result with a good appearance while avoiding concentration of needle drop points, in a case where embroidery sewing is performed to fill a block that forms an embroidery pattern.

Embodiments provide an embroidery data creation apparatus that includes an outline data acquisition portion that acquires outline data. The outline data is data indicating an outline that defines a closed area. The embroidery data creation apparatus also includes a thread density data acquisition portion that acquires thread density data. The thread density data is data indicating a density of stitches that fill the closed area by alternately connecting a pair of line segments that face each other and that are included in the outline. The embroidery data creation apparatus further includes a needle drop point setting portion that sets a plurality of first needle drop points, a plurality of second needle drop points, and a sewing order to alternately connect the plurality of first needle drop points and the plurality of second needle drop points using the stitches. The plurality of first needle drop points are set, based on the outline data and the thread density data, on a first line segment that is a longer line segment of the pair of line segments. The plurality of second needle drop points are set, based on the outline data and the thread density data, on a second line segment that is a shorter line segment of the pair of line segments. The embroidery data creation apparatus further includes a needle drop point change portion that, in a case where one of a value of a ratio of a length of the first line segment to a length of the second line segment and a difference between the length of the first line segment and the length of the second line segment is equal to or more than a specified threshold value, changes positions of some of the plurality of second needle drop points, respectively, to positions each of which will be covered by a stitch formed by connecting a first stitch end point and a second stitch end point. The first stitch end point is one of the plurality of first needle drop points that is next to each of the some of the second needle drop points in the sewing order. The second stitch end point being one of the plurality of second needle drop points that is next to the first stitch end point in the sewing order. The embroidery data creation apparatus further includes an embroidery data creation portion that creates embroidery data. The embroidery date is data that identifies respective positions of the plurality of first needle drop points and the plurality of second needle drop points, and the sewing order.

Embodiments also provide a non-transitory computer-readable medium storing a control program executable on an embroidery data creation apparatus. The program includes instructions that cause a computer of the embroidery data creation apparatus to perform the steps of acquiring outline data, the outline data is data indicating an outline that defines a closed area, acquiring thread density data, the thread density data is data indicating a density of stitches that fill the closed area by alternately connecting a pair of line segments that face each other and that are included in the outline, setting a plurality of first needle drop points, a plurality of second needle drop points, and a sewing order to alternately connect the plurality of first needle drop points and the plurality of second needle drop points using the stitches, the plurality of first needle drop points are set, based on the outline data and the thread density data, on a first line segment that is a longer line segment of the pair of line segments, and the plurality of second needle drop points are set, based on the outline data and the thread density data, on a second line segment that is a shorter line segment of the pair of line segments, changing positions of some of the plurality of second needle drop points, respectively, to positions each of which will be covered by a stitch formed by connecting a first stitch end point and a second stitch end point in a case where one of a value of a ratio of a length of the first line segment to a length of the second line segment and a difference between the length of the first line segment and the length of the second line segment is equal to or more than a specified threshold value, the first stitch end point is one of the plurality of first needle drop points that is next to each of the some of the second needle drop points in the sewing order, and the second stitch end point is one of the plurality of second needle drop points that is next to the first stitch end point in the sewing order, and creating embroidery data, the embroidery data is data that identifies respective positions of the plurality of first needle drop points and the plurality of second needle drop points, and the sewing order.

BRIEF DESCRIPTION OF THE DRAWINGS

Embodiments will be described below in detail with reference to the accompanying drawings in which:

FIG. 3 is an explanatory diagram of a change frequency table;

FIG. 4 is an explanatory diagram of a correction coefficient table;

DETAILED DESCRIPTION

Hereinafter, an embodiment of the present disclosure will be explained with reference to the accompanying drawings.

Figure 1:
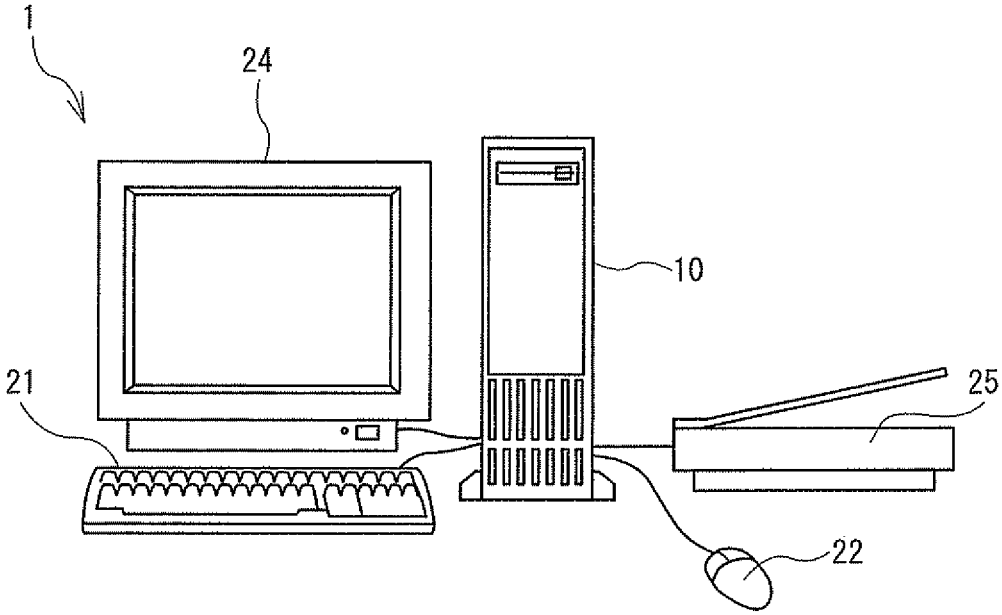
FIG. 1 is an external view of an embroidery data creation apparatus.
Figure 2:
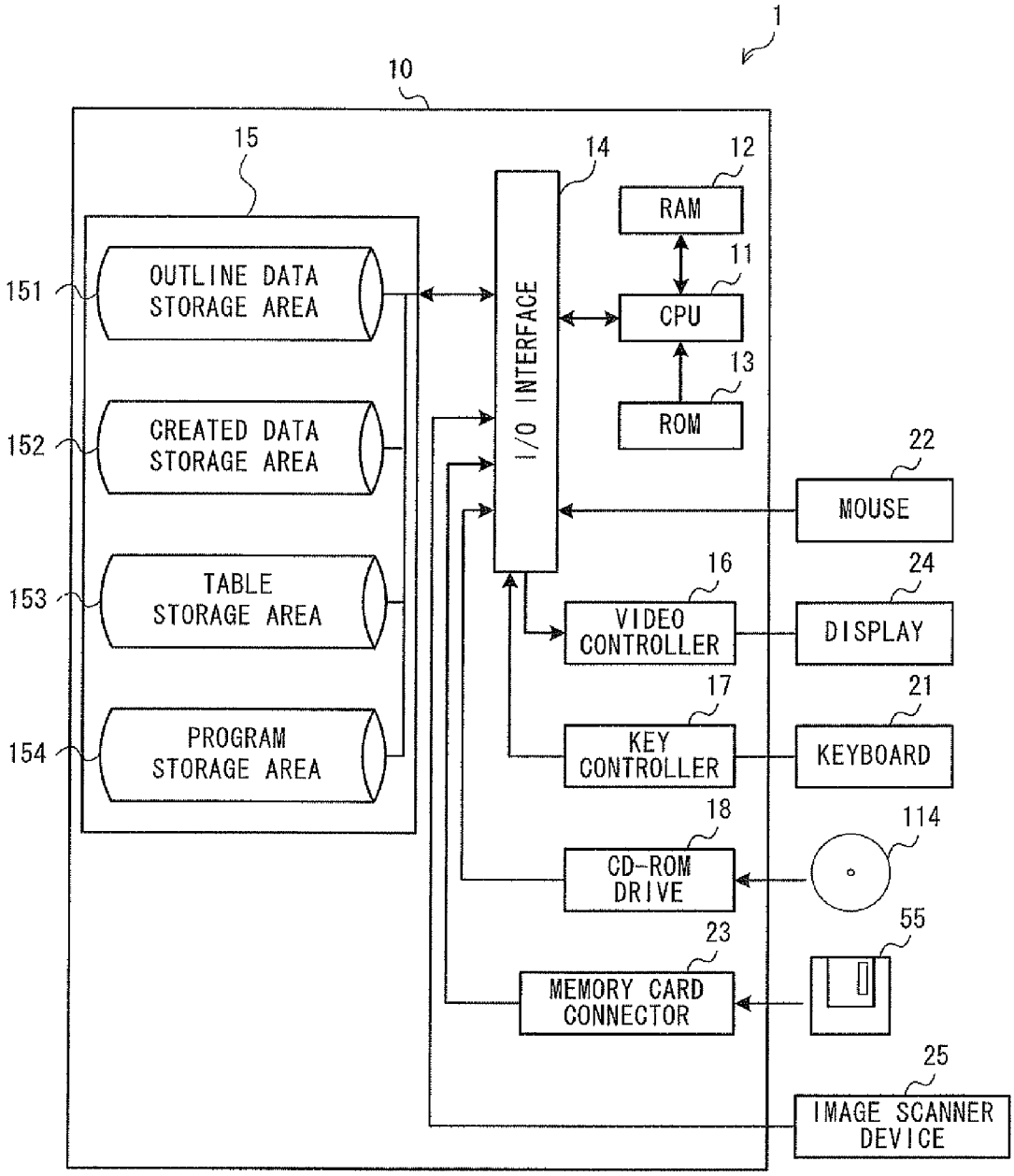
FIG. 2 is a block diagram showing an electrical configuration of the embroidery data creation apparatus.

A configuration of an embroidery data creation apparatus 1 will be explained with reference to FIG. 1 and FIG. 2. The embroidery data creation apparatus 1 is an apparatus that creates embroidery data that may be used to sew an embroidery pattern using a sewing machine 3, which will be described later. The embroidery data creation apparatus 1 of the present embodiment can create embroidery data to perform embroidery sewing so as to fill each block of an embroidery pattern that is formed by one or more blocks. As shown in FIG. 1, the embroidery data creation apparatus 1 may be a general-purpose apparatus, such as a personal computer, for example. The embroidery data creation apparatus 1, an example of which is shown in FIG. 1, may include an apparatus body 10, and with a keyboard 21, a mouse 22, a display 24 and an image scanner device 25 that may be connected to the apparatus body 10.

An electrical configuration of the embroidery data creation apparatus 1 will be explained with reference to FIG. 2. As shown in FIG. 2, the embroidery data creation apparatus 1 includes a CPU 11, which is a controller that can control the embroidery data creation apparatus 1. A RAM 12, a ROM 13 and an input/output (I/O) interface 14 are connected to the CPU 11. The RAM 12 can temporarily store various types of data. The ROM 13 can store BIOS etc. The input/output (I/O) interface 14 can perform relay of transmission and reception of data. A hard disk device (HDD) 15, a mouse 22 that is an input device, a video controller 16, a key controller 17, a CD-ROM drive 18, a memory card connector 23 and the image scanner device 25 are connected to the I/O interface 14. Further, although not shown in FIG. 2, the embroidery data creation apparatus 1 may be provided with an external interface to connect with an external device and a network.

The HDD 15 has a plurality of storage areas including an outline data storage area 151, a created data storage area 152, a table storage area 153 and a program storage area 154. Outline data that is prepared in advance may be stored in the outline data storage area 151 and the outline data represents a contour of an embroidery pattern. The embroidery pattern may be formed using a block or blocks as basic units. The block herein means a closed area of any one of various shapes, such as a rectangular shape, a triangular shape, a fan-like shape, a circular shape, an annular shape and the like. The embroidery pattern may be formed by a single block having one of the above shapes. On the other hand, the embroidery pattern may be formed by a plurality of blocks as in a case of an alphabet, a character, a symbol or another general design. In a case where the embroidery pattern is formed by a plurality of blocks, the outline data of the embroidery pattern includes the outline data of the plurality of blocks.

Figure 8:
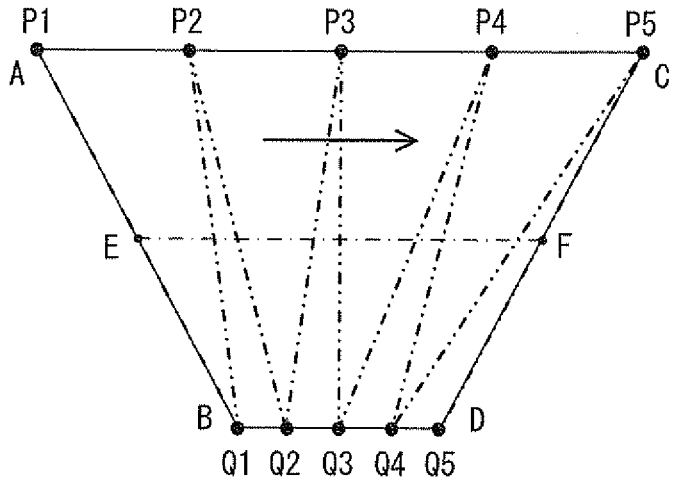
FIG. 8 is an explanatory diagram of first needle drop points and second needle drop points that are initially set on a first line segment AC and a second line segment BD, respectively.

In a case where the block has a rectangular shape or a triangular shape, the outline data includes coordinate data of start points and end points of a each line segments that form the outline of the block, data indicating that linear elements are straight lines, and data of an embroidering direction. In a case where the block has a rectangular shape, such as a trapezoidal shape, reference numerals A to D can be assigned to four vertices. The embroidering direction may be specified by the assigned reference numerals. As shown in FIG. 8, normal embroidery sewing, in which the block is filled with stitches, is performed such that a sewing needle is dropped alternately on a pair of line segments AC and BD that face each other, and zigzag stitches are formed. Needle drop points that are adjacent to each other on the line segment AC are arranged at equal intervals and needle drop points that are adjacent to each other on the line segment BD are arranged at equal intervals. The zigzag stitches intersect with the embroidering direction that is shown by an arrow. The vertex A or the vertex B may be set as a start point of the zigzag stitches. The vertex D or the vertex C at an opposing corner of the start point may be set as an end point of the zigzag stitches.

In a case where the block has a triangular shape, there are no pair of line segments that face each other. In a case where the block has a triangular shape, two reference numerals may be assigned to one vertex that faces one line segment. The vertex to which the two reference numerals are assigned regarded as one line segment. Thus, even in a case where the block has a triangular shape, the block can be treated in a similar manner to a case that one of a pair of line segments that face each other in a rectangle is significantly short.

Further, also in a case where the block has a fan-like shape, the reference numerals A to D are assigned to vertices in a similar manner. The embroidering direction may be specified by the assigned reference numerals. Note that, in a case where the block has a fan-like shape, the outline data also includes data indicating that a pair of line segments is arcs. Note that the fan-like shape includes not only a shape in which the contour is defined by four line segments, but also a shape in which one side of a triangle is arc-shaped (i.e., a shape in which the contour is defined by three line segments). In a case where the block has a circular shape, the outline data includes coordinates of three points on an outer periphery of the block, and data indicating that the block is a circle. In a case where the block has an annular shape, the outline data includes three points on an outer periphery of the block, one point on an inner periphery of the block, and data indicating that the block has an annular shape.

In this manner, the outline data of various shapes of blocks may be stored in the outline data storage area 151. Note that a method for dividing an embroidery pattern into a plurality of blocks is known. For example, Japanese Patent No. 3063100 (U.S. Pat. No. 5,227,976) discloses the method for dividing an embroidery pattern into a plurality of blocks, relevant portions of which are incorporated herein by reference. Data of a plurality of blocks created by this method may be used as the outline data of the embroidery pattern.

The embroidery data created by an embroidery data creation program that may be executed by the CPU 11 may be stored in the created data storage area 152. The embroidery data herein means data that may be used in a case where embroidery is performed by the sewing machine 3. The embroidery data includes at least information indicating stitches (i.e., coordinates of needle drop points and a sewing order). In the present embodiment, the embroidery data is created to perform embroidery sewing such that each block (a closed area having a triangular shape, a rectangular shape, a fan-like shape and the like) of the embroidery pattern formed by one or more blocks is filled by stitches. The created embroidery data may be stored in the created data storage area 152. A method for creating the embroidery data will be described in detail later.

Various types of tables (details of which will be described later) may be stored in the table storage area 153, and the tables may be referred to in embroidery data creation processing etc., which will be described later. A plurality of programs including the embroidery data creation program executed by the CPU 11 may be stored in the program storage area 154. Note that, in a case where the embroidery data creation apparatus 1 does not include the HDD 15, the embroidery data creation program may be stored in the ROM 13. The HDD 15 additionally includes a storage area etc. in which various types of set values may be stored, and the stored set values may be referred to in the embroidery data creation processing etc.

The display 24, which is a display device that displays information, may be connected to the video controller 16. The keyboard 21, which is an input device, may be connected to the key controller 17. A CD-ROM 114 can be inserted into the CD-ROM drive 18. For example, in a case where the embroidery data creation program is set up, the CD-ROM 114 in which the embroidery data creation program may be stored is inserted into the CD-ROM drive 18. Then, the embroidery data creation program may be read and stored in the program storage area 154 of the HDD 15. Information can be read and written by connecting a memory card 55 to the memory card connector 23.

Examples of the various types of tables that may be stored in the table storage area 153 of the HDD 15 will be explained with reference to FIG. 3 and FIG. 4. A change frequency table 157 shown in FIG. 3 is a table in which a frequency of changing initial set positions of needle drop points may be set. The embroidery data to perform embroidery sewing so as to fill the block can be created in the following manner. First, a pair of line segments may be identified which face each other and which are included in the outline that defines the contour of the block. Next, a plurality of needle drop points may be arranged on the identified pair of line segments. Coordinates in an X-Y coordinate system that is unique to the sewing machine 3 (which will be described later) and a sewing order are determined for each of the arranged needle drop points, and thus the embroidery data can be created. In the present embodiment, the needle drop points on a longer line segment (hereinafter referred to as a first line segment) of the pair of line segments may not be changed from the initially arranged positions. However, some of the needle drop points on a shorter line segment (hereinafter referred to as a second line segment) may be changed from the initially arranged positions.

As shown in FIG. 3, a change frequency m may be set in the change frequency table 157, in accordance with a value of a ratio of a length of the first line segment to a length of the second line segment. A value of the change frequency m indicates how often (once in how many times) the positions of the needle drop points arranged on the second line segment will be changed. Accordingly, this indicates that the smaller the value of the change frequency m is, the higher the change frequency is. In the example shown in FIG. 3, in a case where the value of the ratio of the length of the first line segment to the length of the second line segment is 1.5 or more and less than 2.5, the change frequency is "3". Therefore, this indicates that one in every three of the needle drop points on the second line segment will be changed in position. In a case where the value of the ratio of the length of the first line segment to the length of the second line segment is equal to or more than 2.5, this indicates that one in every two of the needle drop points on the second line segment will be changed in position. In other words, the positions of the needle drop points that are adjacent to each other on the second line segment will not be both changed, and the number of the needle drop points on the second line segment whose positions will be changed is equal to or less than one-half of the total number of the needle drop points on the second line segment. Further, the larger the value of the ratio of the length of the first line segment to the length of the second line segment, the larger the number of the needle drop points on the second line segment whose positions will be changed.

Note that the positions of the needle drop points on the second line segment may be set such that they will not changed in a case where the value of the ratio of the length of the first line segment to the length of the second line segment is less than a threshold value. In the present embodiment, the threshold value is set to 1.5. Therefore, in a case where the value of the ratio of the length of the first line segment to the length of the second line segment is less than 1.5, the positions of the needle drop points on the second line segment will be not changed.

A correction coefficient table 158 shown in FIG. 4 is a table that may be used to identify a correction coefficient X to change the needle drop point position in accordance with a thread density that may be set for the embroidery pattern to be sewn. The thread density herein means the density of stitches to fill a block. In the present embodiment, in a case where the value of the ratio of the length of the first line segment to the length of the second line segment is equal to or more than the threshold value (1.5), the positions of some of the needle drop points on the second line segment will be each changed to one point on a virtual line segment. The virtual line segment herein means a line segment that connects a needle drop point that is next to a change target needle drop point in the sewing order and a further next needle drop point. The change target needle drop point herein means a needle drop point whose position will be changed. The correction coefficient X herein means a coefficient that may be used to determine the one point on the virtual line segment. Specifically, the one point on the virtual line segment that is separated from the needle drop point next to the change target needle drop point by a distance obtained by multiplying the length of the virtual line segment by the correction coefficient X, may be determined as the changed needle drop point.

In the present embodiment, the thread density defines the number of stitches per 1 mm that cut across a line segment (hereinafter referred to as a block center line) that connects two midpoints of two line segments that are obtained by connecting start points and end points of each pair of line segments on which needle drop points are set. As shown in FIG. 4, in the present embodiment, the correction coefficient X is set to "0.8", "0.7" and "0.6" respectively corresponding to three thread density ranges, i.e., "less than 3.5 stitches/mm", "3.5 stitches/mm or more and less than 4.5 stitches/mm" and "4.5 stitches/mm or more". In the present embodiment, as the thread density becomes higher, the changed needle drop point position becomes closer to the needle drop point that is next to the change target needle drop point in the sewing order, namely, closer to the first line segment.

The sewing machine 3 that can sew an embroidery pattern based on the embroidery data created by the embroidery data creation apparatus 1 will be briefly explained with reference to FIG. 5.

Figure 5:
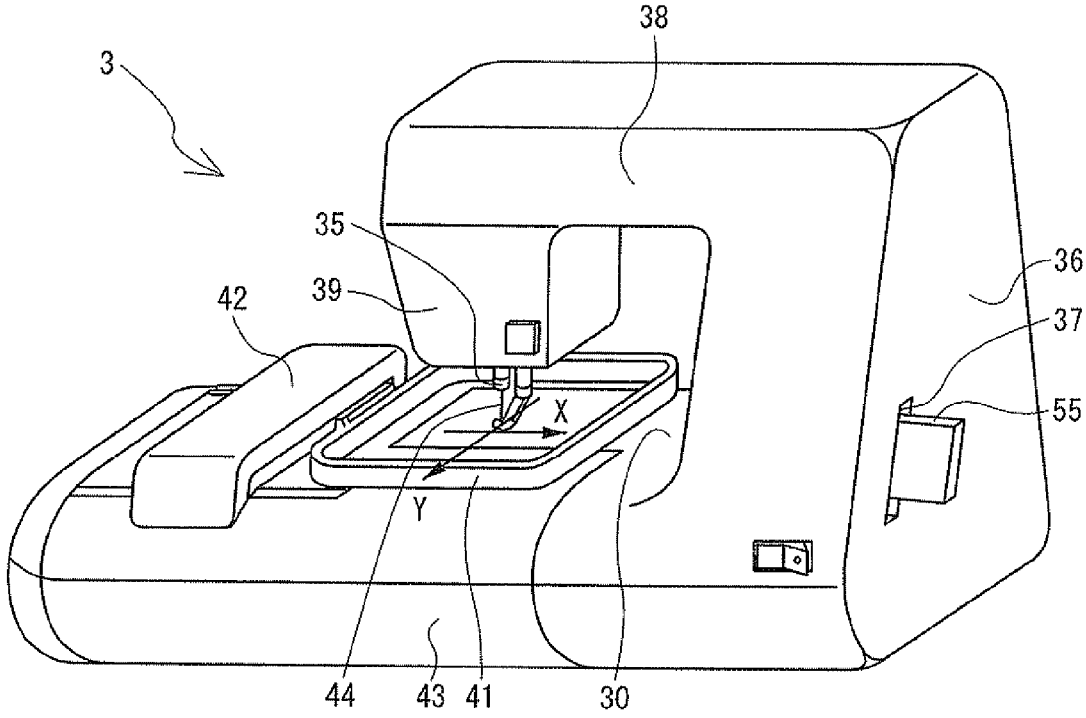
FIG. 5 is an external view of a sewing machine.

As shown in FIG. 5, the sewing machine 3 has a bed portion 30, a pillar 36, an arm portion 38 and a head portion 39. The bed portion 30 is a base portion of the sewing machine 3, and it is longer in the left-right direction with respect to a sewing person. The pillar 36 extends in the upward direction from a right end portion of the bed portion 30. The arm portion 38 extends in the leftward direction from the upper end of the pillar 36 such that it faces the bed portion 30. The head portion 39 is a portion that connects to the left end of the arm portion 38. An embroidery frame 41, which can hold a work cloth on which embroidery will be sewn, can be placed above the bed portion 30.

When embroidery sewing is performed, the embroidery frame 41 is moved to the needle drop point indicated by the X-Y coordinate system that is unique to the sewing machine 3, by a Y-direction drive portion 42 that is placed on the bed portion 30 and an X-direction drive mechanism (not shown in the drawings) that may be housed in a body case 43. A needle bar 35 to which a sewing needle 44 is attached, and a shuttle mechanism (not shown in the drawings) may be driven in accordance with the embroidery frame 41 being moved, and thus an embroidery pattern can be formed on the work cloth. Note that the Y-direction drive portion 42, the X-direction drive mechanism, the needle bar 35 and the like may be controlled, based on the embroidery data, by a control apparatus (not shown in the drawings) that includes a microcomputer incorporated in the sewing machine 3.

A memory card slot 37 is provided on a side surface of the pillar 36 of the sewing machine 3, and the memory card 55 can be inserted into and removed from the memory card slot 37. For example, the embroidery data created by the embroidery data creation apparatus 1 may be stored in the memory card 55 via the memory card connector 23. After that, the memory card 55 can be inserted into the memory card slot 37 of the sewing machine 3, and the stored embroidery data can be read out and stored in the sewing machine 3. Based on the embroidery data read out from the memory card 55, the control apparatus (not shown in the drawings) of the sewing machine 3 may control sewing operations of the embroidery pattern performed by the above-described elements. In this manner, the embroidery pattern can be sewn using the sewing machine 3, based on the embroidery data created by the embroidery data creation apparatus 1.

Hereinafter, the embroidery data creation processing that may be performed by the embroidery data creation apparatus 1 of the present embodiment will be explained with reference to FIG. 6 to FIG. 10. The embroidery data creation processing is started when the embroidery data creation program stored in the program storage area 154 of the HDD 15 is activated, and is performed by the CPU 11 executing this program.

Figure 6:
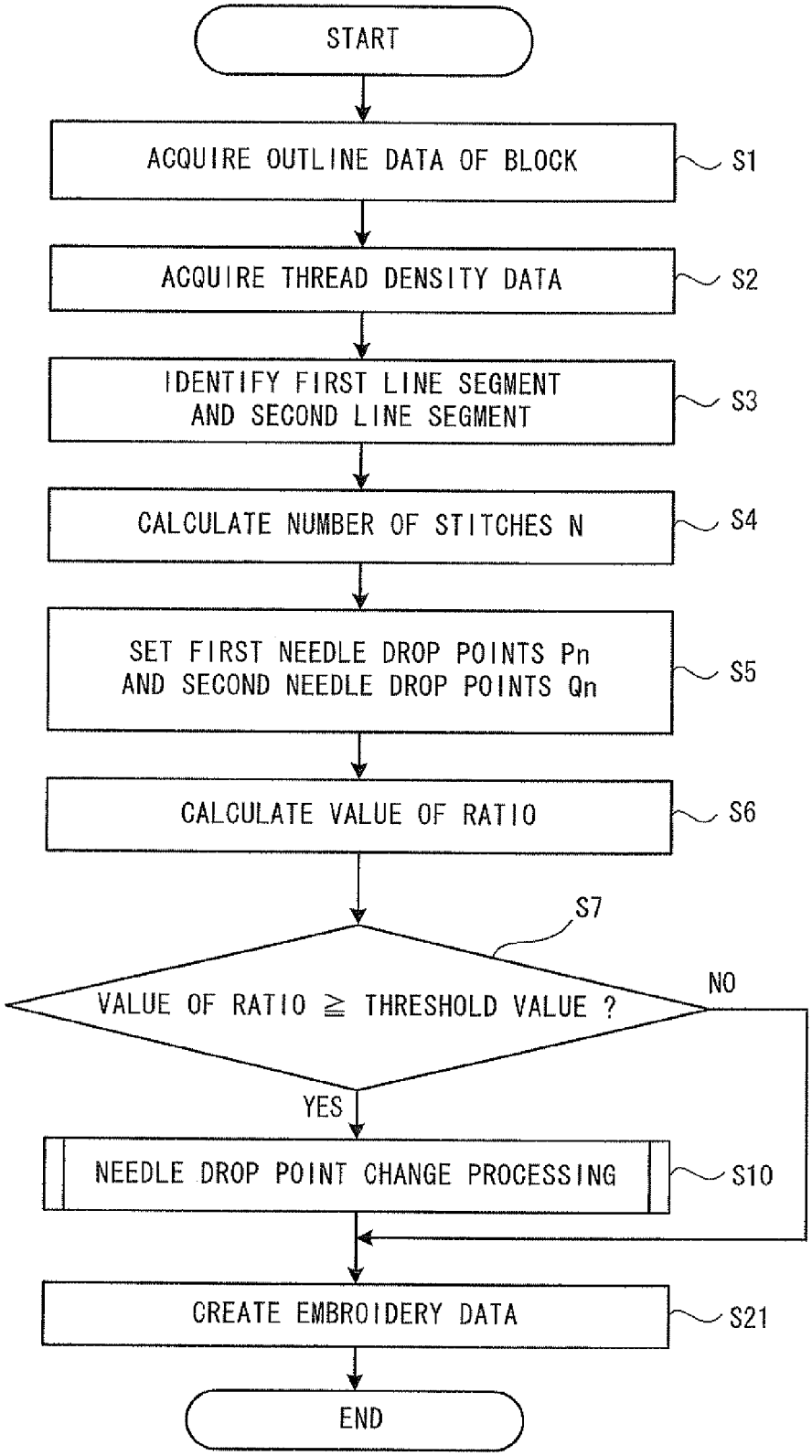
FIG. 6 is a main flowchart of embroidery data creation processing.

As shown in FIG. 6, in the embroidery data creation processing, first, the outline data of the block that forms the embroidery pattern is acquired and the acquired outline data is stored in a predetermined storage area of the RAM 12 (step S1). The outline data of the block may be acquired using any method. For example, the shapes of the embroidery patterns whose outline data may be stored in the outline data storage area 151 (refer to FIG. 2) may be displayed on the display 24, and the outline data corresponding to the embroidery pattern selected by a user may be read out from the outline data storage area 151. In a case where the embroidery pattern is formed by a plurality of blocks, a plurality of outline data items are read out and processing that will be explained below is performed on each of the plurality of data items.

Alternatively, the outline data of the block may be acquired by performing known closed area extraction processing on an image that is read by the image scanner device 25, for example, and stored in the RAM 12. For example, Japanese Laid-Open Patent Publication No. H11-123289 discloses the known closed area extraction processing, relevant portions of which are incorporated herein by reference.

In addition, the outline data may be acquired by operations of the mouse 22. For example, on a particular instruction screen displayed on the display 24, a group of line segments obtained by sequentially connecting positions of a pointer at while the mouse 22 is clicked may be acquired as the outline data. Further, the outline data may be acquired using, as the outline, a movement locus of the pointer that moves in accordance with an operation of the mouse 22 and that is displayed on the display 24. In this case, if the movement locus of the pointer is not closed, a start point and an end point of the movement locus may be connected and the obtained closed area may be treated as a block. Further, the outline data of a closed area of a given shape may be input to the embroidery data creation apparatus 1 from the memory card 55 or from the outside via the memory card connector 23 or an external interface (not shown in the drawings), and the input outline data may be used.

Note that, in a case where the image read by the image scanner device 25 or the closed area etc. identified by the specification of the user is used, the shape of the image or the closed area etc. may not be limited to a simple shape, such as a rectangular shape, a triangular shape, a fan-like shape, a circular shape, an annular shape or the like. In this type of case, the known method for dividing an embroidery pattern into a plurality of blocks may be used to divide the identified closed area into a plurality of blocks. For example, Japanese Patent No. 3063100 (U.S. Pat. No. 5,227,976) discloses the method for dividing an embroidery pattern into a plurality of blocks, relevant portions of which are incorporated herein by reference. The processing explained below may be performed on each data item of each of the blocks created by this method.

After the outline data has been acquired, thread density data is acquired. The acquired thread density data is stored in the RAM 12 (step S2). In the present embodiment, a default value of the thread density is defined as four stitches per 1 mm (four stitches/mm), and is stored in the HDD 15 as a set value. At step S2, the set value is read out and displayed on a setting screen displayed on the display 24. The default value may be changed by an input operation from the keyboard 21. Accordingly, at step S2, in a case where the thread density is not changed, data indicating the default value is acquired as the thread density data. In a case where the thread density is changed, data indicating the changed thread density is acquired as the thread density data.

The first line segment and the second line segment are identified based on coordinates of vertices indicated by the outline data of the block acquired at step S1 (step S3). The first line segment herein means a longer line segment of the pair of line segments on which needle drop points will be arranged. The second line segment herein means a shorter line segment of the pair of line segments on which needle drop points will be arranged. For example, in a case where the outline data of the trapezoid shown in FIG. 8 is acquired at step S1, the line segment AC is identified as the first line segment and the line segment BD is identified as the second line segment. Note that, in a case where the length of the line segment AC is the same as the length of the line segment BD, one of them may be set as the first line segment and the other line segment may be set as the second line segment.

A number of stitches N is calculated based on the outline data and the thread density data (step S4). The number of stitches N herein means the number of stitches that cut across the center line of the block. In a case of the trapezoid shown in FIG. 8, a line segment EF is identified as the center line of the block from the outline data. The line segment EF is a line segment obtained by connecting a midpoint E of a line segment AB obtained by connecting a start point A of the first line segment AC and a start point B of the second line segment BD, and a midpoint F of a line segment CD obtained by connecting an end point C of the first line segment AC and an end point D of the second line segment BD. In a case where the length of the center line of the block is 1 mm and the thread density is the default value of "four stitches/mm", the number of stitches N is four. Note that the number of stitches N of the present embodiment is counted such that stitches that go back and forth between the first line segment AC and the second line segment BD are deemed to be one stitch. Therefore, the number of stitches that will be actually sewn on a work cloth is double the calculated number of stitches N in the present embodiment.

Based on the number of stitches N, needle drop points are respectively set on the first line segment and the second line segment, and the sewing order of the set needle drop points is determined (step S5). More specifically, the first line segment AC and the second line segment BD are respectively divided into N parts. The needle drop points are set to respective dividing points. Note that, hereinafter, the needle drop points set on the first line segment at step S5 are referred to as first needle drop points Pn (n is an integer from 1 to N+1), and the needle drop points set on the second line segment are referred to as second needle drop points Qn (n is an integer from 1 to N+1). Data that indicates coordinates and the sewing order of the set first needle drop points Pn and the second needle drop points Qn are stored in the RAM 12.

In a case where the number of stitches N is four, as exemplified in FIG. 8, the first line segment AC is divided into four parts and first needle drop points P1 to P5 are set. Note that the first needle drop point P1, is set at the start point A of the first line segment AC. The first needle drop point P5 is set at the end point C of the first line segment AC. Further, the second line segment BD is divided into four parts and second needle drop points Q1 to Q5 are set. Note that the second needle drop point Q1 is set at the start point B of the second line segment BD. The second needle drop point Q5 is set at the end point D of the second line segment BD. The sewing order is set such that the first needle drop point P1 located at the vertex A is taken as the start point, and the first needle drop points Pn and the second needle drop points Qn are alternately connected in the embroidering direction (the direction of the arrow). In the example shown in FIG. 8, the sewing order is set in the order of P1, Q1, P2, Q2, P3, Q3, P4, Q4, P5 and Q5.

Based on the coordinates of the vertices of the block, the value of the ratio of the length of the first line segment to the length of the second line segment is calculated and stored in the RAM 12 (step S6). In the present embodiment, in accordance with the value of the ratio of the length of the first line segment to the length of the second line segment, a determination is made as to whether it is necessary to change the positions of the second needle drop points Qn set on the second line segment, and a frequency of the position change is determined. It is determined whether the value of the ratio of the length of the first line segment to the length of the second line segment is equal to or more than the threshold value (step S7). In the present embodiment, as described above, the threshold value has been set in advance to 1.5 and is stored in the HDD 15. Alternatively, a threshold value may be set by the user may be used.

In a case where the value of the ratio of the length of the first line segment to the length of the second line segment is less than the threshold value (no at step S7), the length of the first line segment is not significantly different from the length of the second line segment. Therefore, the positions of the second needle drop points will be changed. In this case, based on the data of the coordinates and the sewing order of the needle drop points set at step S5 and may be stored in the RAM 12, the embroidery data to cause the sewing machine 3 to perform embroidery sewing is created (step S21). Specifically, the stored coordinates of the needle drop points are converted to coordinates of the coordinate system that is unique to the sewing machine 3. Then, the embroidery data is created that includes the converted coordinate data, the data indicating the sewing order, and further, data indicating an embroidery thread color. The created embroidery data is stored in the created data storage area 152 (refer to FIG. 2) of the HDD 15. After that, the embroidery data creation processing shown in FIG. 6 ends.

In a case where the value of the ratio of the length of the first line segment to the length of the second line segment is equal to or more than the threshold value (yes at step S7), the length of the first line segment is significantly different from the length of the second line segment. Therefore, if the first needle drop points Pn and the second needle drop points Qn set at step S5 are used as they are, there may be a case in which the second needle drop points Qn are densely arranged on the second line segment. In this case, the appearance of the embroidery pattern may deteriorate and at the same time, thread breakage or needle breakage may occur. To address this, needle drop point change processing is performed in which the positions of some of the second needle drop points Qn are changed (step S10 and FIG. 7).

Figure 7:
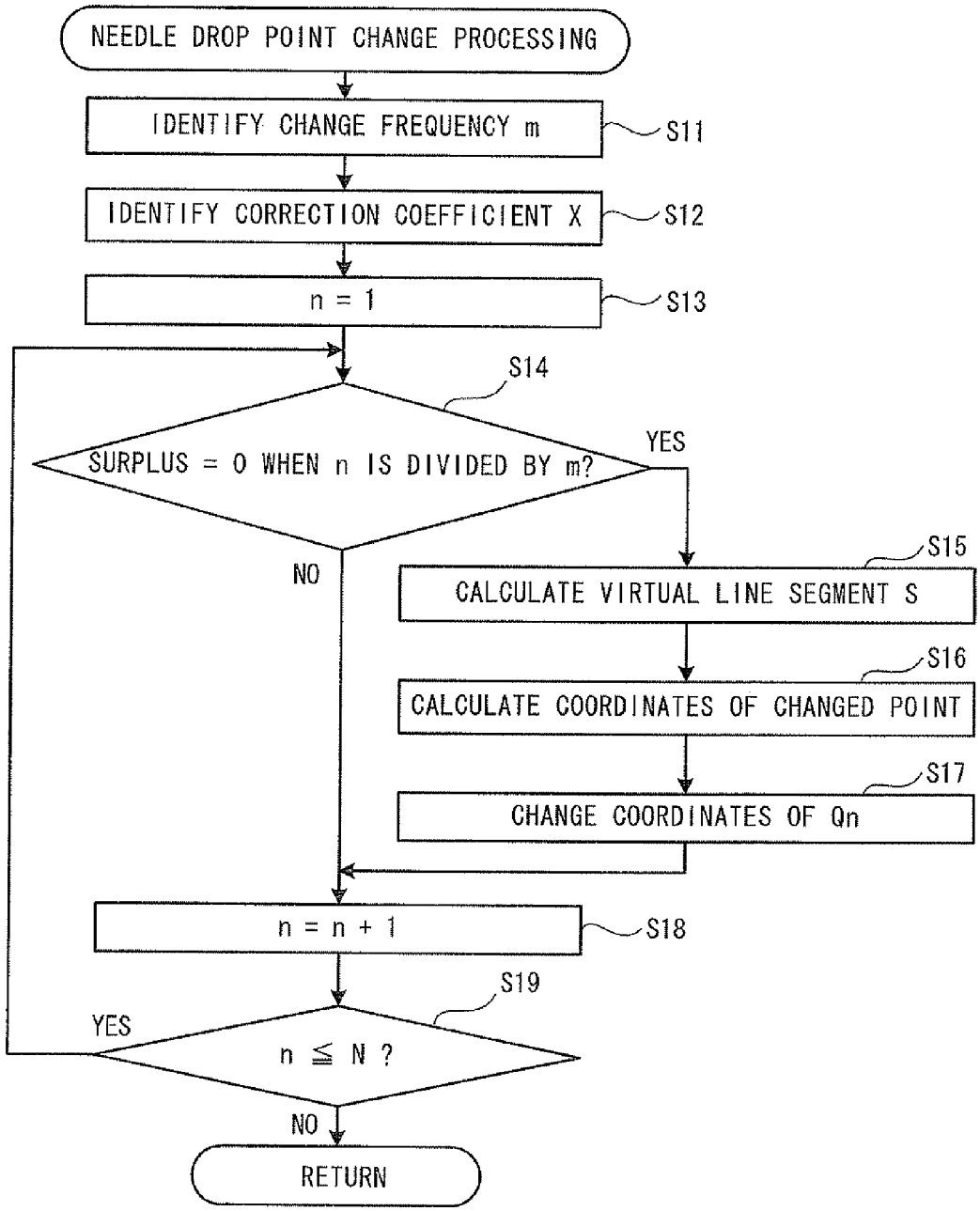
FIG. 7 is a flowchart of needle drop point change processing that is performed in the embroidery data creation processing.

As shown in FIG. 7, in the needle drop point change processing, first, the change frequency m is identified (step S11). Specifically, the change frequency table 157 (refer to FIG. 3) stored in the table storage area 153 is referred to, and the change frequency m is identified that corresponds to the value of the ratio of the length of the first line segment to the length of the second line segment stored in the RAM 12. For example, in a case where the calculated value of the length ratio is 3, the change frequency m is 2. In other words, it is specified that one in every two of the second needle drop points Qn will be changed.

Subsequently, the correction coefficient X is identified (step S12). Specifically, the correction coefficient table 158 (refer to FIG. 4) stored in the table storage area 153 is referred to, and the correction coefficient X is identified that corresponds to the thread density indicated by the thread density data stored in the RAM 12. For example, in a case where the thread density is the default value of "four stitches/mm", the correction coefficient X is 0.7. In other words, it is specified that, on a virtual line segment that connects a first needle drop point that is next to a change target second needle drop point in the sewing order (hereinafter referred to as a first stitch end point) and a second needle drop point that is next to the first stitch end point in the sewing order (hereinafter referred to as a second stitch end point), the change target second needle drop point will changed to a point in a position that is separated from the first stitch end point by a distance obtained by multiplying the length of the virtual line segment by 0.7.

A variable n to identify the change target second needle drop point Qn is set to 1 and stored in the RAM 12 (step S13). The variable n is divided by the change frequency m to determine whether the residual is zero (step S14). In a case where the change frequency m is 2, the residual is not zero in initial processing (n=1) (no at step S14). Therefore, 1 is added to the variable n and the variable n is changed to 2 (step S18). Next, it is determined whether the value of the variable n is equal to or less than the number of stitches N (step S19). In a case where the value of the variable n is equal to or less than the number of stitches N (yes at step S19), the processing has not yet been completed for all of the second needle drop points Pn. Therefore, the processing returns to step S14.

In a case where the variable n is changed to 2, the residual is zero when the variable n is divided by the change frequency m (2) (yes at step S14). In such a case, a virtual line segment S that connects the first stitch end point and the second stitch end point is calculated (step S15). The first stitch end point herein means the first needle drop point that is next to the change target second needle drop point Qn in the sewing order. In a ease where the sewing order is started from the start point P1 of the first line segment, the first stitch end point is Pn+1. In a case where the sewing order is started from the start point Q1 of the second line segment, the first stitch end point is Pn. The second stitch end point herein means the second needle drop point that is next to the first stitch end point in the sewing order. In other words, the second stitch end point herein means the second needle drop point that is second, in the sewing order, from the change target second needle drop point Qn, and the second stitch end point is expressed as Qn+1. Then, based on the calculated virtual line segment S and the correction coefficient X, coordinates of the changed point on the virtual line segment S is calculated (step S16). Specifically, a distance L, which can be obtained by multiplying the length of the virtual line segment S by the correction coefficient X, is calculated. A point on the virtual line segment S, which is separated from the first stitch end point by the distance L, is set as the changed point and the coordinates of that point is calculated.

In the example shown in FIG. 8, in a case where the variable n is 2, namely, in a case where the second needle drop point Q2 is set as the change target, the needle drop point that is first in the sewing order is the start point P1 of the first line segment. Therefore, a line segment P3Q3 is calculated as the virtual line segment S at step S15. Further, in a case where the correction coefficient is 0.7, the coordinates of the changed point on the line segment P3Q3 is calculated at step S16. The changed point is separated from the first needle drop point P3 by a distance obtained by multiplying the length of the line segment P3Q3 by 0.7.

The coordinates of the processing target second needle drop point Qn stored in the RAM 12 is changed to the calculated coordinates of the changed point (step S17). 1 is added to the variable n (step S18), and if the variable n is equal to or less than the number of stitches N (yes at step S19), the processing returns to step S14 and the change processing of the next change target second needle drop point Qn is performed. Then, while the variable n is equal to or less than the number of stitches N (yes at step S19), the above-described change processing is repeated.

Figure 9:
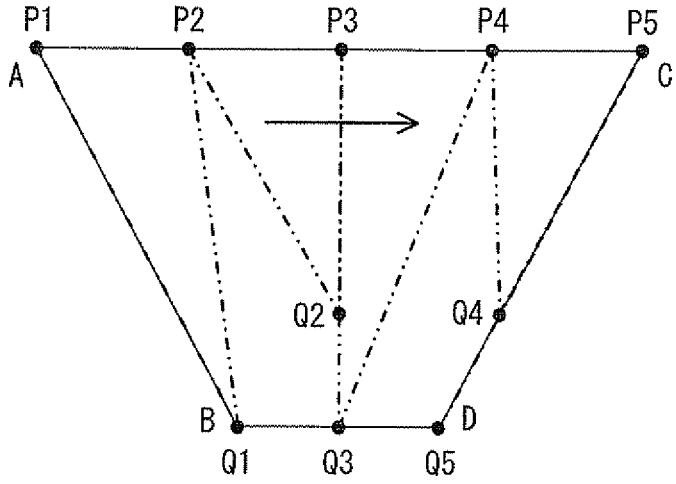
FIG. 9 is an explanatory diagram of the first needle drop points and the second needle drop points after the needle drop point change processing.

If the needle drop point change processing is performed on the remaining second needle drop points Q3 to Q5 shown in the example in FIG. 8, in a case where n=3, the residual obtained by dividing the second needle drop point Q3 by the change frequency m (2) is not zero (no at step S14). Therefore, the position of the second needle drop point Q3 is not be changed. In a case where n=4, the residual is zero for the second needle drop point Q4 (yes at step S14). Therefore, the position of the second needle drop point Q4 is changed to a position that is separated from the first needle drop point P5 by the distance L (the length of the line segment P5Q5×0.7) on a line segment P5Q5 (step S15 to step S17). After that, 1 is added to the variable n and the variable n is changed to 5 (step S18), thus exceeding the number of stitches N (4) (no at step S19), In this case, the second needle drop point Qn+1, namely, a second needle drop point Q6, does not exist and the virtual segment S also does not exist. Therefore, the position of the second needle drop point Q5 cannot be changed. This means that the processing has been completed for all the second needle drop points Qn, and the needle drop point change processing ends. As shown in FIG. 9, as a result of the processing, the positions of the second needle drop points Q2 and Q4 have been respectively changed to the position on the line segment P3Q3 and the position on the line segment P5Q5.

As shown in FIG. 6, after the needle drop point change processing (step S10, FIG. 7), the embroidery data to cause the sewing machine 3 to perform embroidery sewing is created (step S21). Specifically, all the coordinates of the needle drop points, including some of the needle drop points whose positions have been changed in the needle drop point change processing at step S10 after the setting at step S5, are converted to coordinates of the coordinate system that is unique to the sewing machine 3. Then, the embroidery data is created that includes the changed coordinate data, the data indicating the sewing order, and further, the data indicating an embroidery thread color. The created embroidery data is stored in the created data storage area 152 (refer to FIG. 2) of the HDD 15. After that, the embroidery data creation processing shown in FIG. 6 ends.

As explained above, in the embroidery data creation apparatus 1 of the present embodiment, the outline data that indicates the outline of the block that forms the embroidery pattern, and the thread density data is acquired. Based on the acquired outline data and thread density data, a plurality of the first needle drop points and a plurality of the second needle drop points are respectively set on the pair of line segments (i.e., the first line segment and the second line segment) that are included in the outline, and at the same time, the sewing order of them is set. In a case where the value of the ratio of the length of the first line segment to the length of the second line segment is equal to or more than the specified threshold value (1.5), the positions of some of the second needle drop points are respectively changed to be on the virtual line segment S that connects the first stitch end point and the second stitch end point. Reflecting the changed positions, the embroidery data is created to perform embroidery sewing such that the block can be filled using the sewing machine 3.

According to the embroidery data creation apparatus 1, in a case where the second needle drop points are densely arranged on the second line segment due to a significantly large difference between the length of the first line segment and the length of the second line segment, the positions of some of the needle drop points set on the second line segment are changed. As a result, it can be possible to avoid denseness of the second needle drop points. In addition, the changed positions of the second needle drop points are set on the virtual line segment S that connects the first needle drop point that is next to the change target second needle drop point in the sewing order (the first stitch end point), and the second needle drop point that is next to the first stitch end point in the sewing order (the second stitch end point). Accordingly, if sewing is performed by the sewing machine 3 based on the embroidery data that is created after the positions of the second needle drop points Q2 and Q4 have been changed as shown in FIG. 9, for example, an embroidery result such as that shown in FIG. 10 may be obtained.

Figure 10:
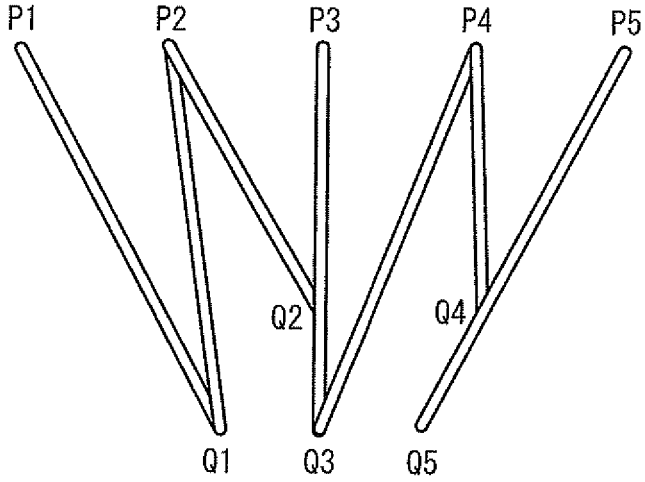
FIG. 10 is a diagram showing an embroidery result based on embroidery data created by the embroidery data creation processing.

As may be apparent from FIG. 10, the second needle drop points Q2 and Q4 whose positions have been changed by the needle drop point change processing may be respectively covered and hidden by a stitch thereafter formed on the line segment P3Q3 and a stitch formed on the line segment P5Q5. If the second needle drop points Q2 and Q4 are changed to positions that cannot be covered and hidden by the stitches, there is a possibility that an embroidery result does not look beautiful as a whole, because the first needle drop points P1 to P5 can be aligned on the same line while the changed second needle drop points Q2 and Q4 may not be aligned on the same line as the second needle drop points Q1, Q3 and Q5 whose positions have not been changed. In contrast to this, in the present embodiment, as shown in FIG. 10, the second needle drop points Q2 and Q4 may not be noticeable because they can be covered and hidden. Therefore, it can be possible to obtain an embroidery result that may look beautiful.

In the present embodiment, some of the second needle drop points whose positions are changed in the embroidery data creation processing are not adjacent to each other when they are set on the second line segment in processing at step S5. Further, the number of some of the second needle drop points whose positions are changed are equal to or less than one-half of the total number of the second needle drop points. Since the positions of some of the second needle drop points are changed under these conditions, the second needle drop points whose positions have been changed can be reliably covered and hidden by the stitches that are formed thereafter. Furthermore, the settings are made by the change frequency table 157 such that the larger the value of the ratio of the length of the first line segment to the length of the second line segment, the larger the number of the second needle drop points whose positions will be changed. Thus, it can be possible to appropriately alleviate a difference between a density level of the first needle drop points on the first line segment and a density level of the second needle drop points on the second line segment.

Moreover, in the present embodiment, in a case where the positions of some of the second needle drop points are changed, as the thread density becomes higher, the changed positions become closer to the first stitch end point on the virtual line segment S. In other words, the positions are changed such that, the higher the thread density, the wider the interval between stitches that can be close to the first line segment. Therefore, it may be possible to avoid the denseness of the second needle drop points after they have been displaced from the initially arranged positions on the second line segment. Therefore, it may be possible to reliably reduce a possibility of thread breakage or needle breakage.

In the present embodiment, in a case where the positions of the second needle drop points are changed, each of the changed second needle drop points is set to the changed point on the virtual line segment S that connects the first stitch end point and the second stitch end point. However, each of the changed points need not be necessarily located strictly on the virtual line segment S, and may be slightly away from the virtual line segment S. This is because an embroidery thread used in embroidery sewing may have a certain width, and even if each of the changed second needle drop points is slightly away from the virtual line segment S, as long as it is covered and hidden by the stitch formed between the first stitch end point and the second stitch end point, an embroidery result that may look beautiful can be obtained while avoiding the denseness of the second needle drop points. In other words, each of the changed second needle drop points may be located in a position that can be covered and hidden by the stitch formed between the first stitch end point and the second stitch end point. Therefore, an allowable range of a distance between each of the changed second needle drop points and the virtual line segment S may depend on the width of the embroidery thread.

Further, in the present embodiment, an example is explained in which a determination as to whether to change the positions of some of the second needle drop points is based on the value of the ratio of the length of the first line segment to the length of the second line segment. However, the determination may be based on a difference between the length of the first line segment and the length of the second line segment, instead of based on the value of the ratio of the length of the first line segment to the length of the second line segment. In this case, at step S7 of the embroidery data creation processing shown in FIG. 6, it may be determined whether the difference between the length of the first line segment and the length of the second line segment is equal to or more than a specified threshold value, In a case where the difference is equal to or more than the specified threshold value (yes at step S7), the needle drop point change processing (step S10) may be performed. The specified threshold value may be a fixed value that may be stored in advance in the HDD 15. Alternatively, the specified threshold value may be a value that may be determined by calculating one-half of the length of the identified second line segment. Note that the threshold value (1.5) used in the present embodiment that is set for the value of the length ratio is merely an example, and it is needless to mention that another value may be used.

Further, in the present embodiment, an example is explained in which the frequency of changing the positions of the second needle drop points is determined in accordance with the value of the length ratio, using the change frequency table 157 shown in FIG. 3. However, the change frequency m may be fixed, regardless of the value of the ratio of the length of the first line segment to the length of the second line segment or the difference between the length of the first line segment and the length of the second line segment. For example, only a threshold value may be used to determine whether to change the positions of some of the second needle drop points may be set, and in a case where the value of the ratio of the length of the first line segment to the length of the second line segment or the difference between the length of the first line segment and the length of the second line segment is equal to or more than the threshold value, the positions may be changed in a case where the variable n is an even number, without exception. In this case, the processing at step S14 of the needle drop point change processing shown in FIG. 7 may be changed to determination processing that determines whether the variable n is an even number or an odd number. In contrast to this, the change frequency may be set based on more finely divided ranges, in accordance with the value of the ratio of the length of the first line segment to the length of the second line segment or the difference between the length of the first line segment and the length of the second line segment. It is needless to mention that an upper limit and a lower limit of each of the ranges cannot be limited to the examples of the present embodiment.

Similarly, also, in a case where the second needle drop points are changed, the positions of the changed points need not necessarily be changed in accordance with the thread density. In other words, the correction coefficient X may be a fixed value. For example, regardless of the thread density, the position on the virtual line segment S that is separated from the first stitch end point by a distance obtained by multiplying the length of the virtual line segment S by a correction coefficient 0.7 may be constantly set as the changed position. Alternatively, the positions of the changed points may be set based on more finely divided ranges, in accordance with the thread density. It is needless to mention that an upper limit and a lower limit of each of the ranges cannot be limited to the examples in the present embodiment. Note that, as described above, the thread density of the present embodiment may be defined by the number of stitches that cut across the center line of the block. Therefore, it is desirable that the positions of the changed points may be closer to the second line segment than the center line of the block.

In the present embodiment, a personal computer may be used as the embroidery data creation apparatus 1. However, the embroidery data creation processing shown in FIG. 6 may be performed by a sewing machine capable of embroidery sewing, such as the sewing machine 3.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data creation apparatus comprising:

an outline data acquisition portion that acquires outline data, the outline data being data indicating an outline that defines a closed area;

a thread density data acquisition portion that acquires thread density data, the thread density data being data indicating a density of stitches that fill the closed area by alternately connecting points arranged on a pair of line segments that face each other and that are included in the outline;

a needle drop point setting portion that sets a plurality of first needle drop points, a plurality of second needle drop points, and a sewing order to alternately connect the plurality of first needle drop points and the plurality of second needle drop points using the stitches, the plurality of first needle drop points being set, based on the outline data and the thread density data, on a first line segment that is a longer line segment of the pair of line segments, and the plurality of second needle drop points being set, based on the outline data and the thread density data, on a second line segment that is a shorter line segment of the pair of line segments;

a needle drop point change portion that, in a case where one of a value of a ratio of a length of the first line segment to a length of the second line segment and a difference between the length of the first line segment and the length of the second line segment is equal to or more than a specified threshold value, changes positions of some of the plurality of second needle drop points, respectively, to positions each of which will be covered by a stitch formed by connecting a first stitch end point and a second stitch end point, the first stitch end point being one of the plurality of first needle drop points that is next to each of the some of the second needle drop points in the sewing order, and the second stitch end point being one of the plurality of second needle drop points that is next to the first stitch end point in the sewing order; and an embroidery data creation portion that creates embroidery data, the embroidery data being data that identifies respective positions of the plurality of first needle drop points and the plurality of second needle drop points, and the sewing order.

2. The embroidery data creation apparatus according to claim 1, wherein the needle drop point change portion changes the positions of the some of the plurality of second needle drop points, respectively, to be on a virtual line segment in a case where one of the value of the ratio of the length of the first line segment to the length of the second line segment and the difference between the length of the first line segment and the length of the second line segment is equal to or more than the specified threshold value, the virtual line segment being a line segment that connects the first stitch end point and the second stitch end point.

3. The embroidery data creation apparatus according to claim 1, wherein a number of the some of the second needle drop points whose positions are changed by the needle drop point change portion is equal to or less than one-half of a total number of the plurality of second needle drop points, and the positions of the some of the second needle drop points on the second line segment that are initially set by the needle drop point setting portion are not adjacent to each other.

4. The embroidery data creation apparatus according to claim 1, wherein in accordance with one of the value of the ratio of the length of the first line segment to the length of the second line segment and the difference between the length of the first line segment and the length of the second line segment, a number of the some of the second needle drop points whose positions are changed by the needle drop point change portion becomes larger as one of the value of the length ratio and the length difference becomes larger.

5. The embroidery data creation apparatus according to claim 1, wherein in accordance with the density acquired by the thread density data acquisition portion, the needle drop point change portion changes the position of each of the some of the second needle drop points to a position that is closer to the first stitch end point, as the density becomes higher.

6. A computer program product stored on a non-transitory computer-readable medium, comprising instructions for causing a processor of an embroidery data creation apparatus to execute the steps of:

acquiring outline data, the outline data being data indicating an outline that defines a closed area;

acquiring thread density data, the thread density data being data indicating a density of stitches that fill the closed area by alternately connecting points arranged on a pair of line segments that face each other and that are included in the outline;

setting a plurality of first needle drop points, a plurality of second needle drop points, and a sewing order to alternately connect the plurality of first needle drop points and the plurality of second needle drop points using the stitches, the plurality of first needle drop points being set, based on the outline data and the thread density data, on a first line segment that is a longer line segment of the pair of line segments, and the plurality of second needle drop points being set, based on the outline data and the thread density data, on a second line segment that is a shorter line segment of the pair of line segments;

changing positions of some of the plurality of second needle drop points, respectively, to positions each of which will be covered by a stitch formed by connecting a first stitch end point and a second stitch end point in a case where one of a value of a ratio of a length of the first line segment to a length of the second line segment and a difference between the length of the first line segment and the length of the second line segment is equal to or more than a specified threshold value, the first stitch end point being one of the plurality of first needle drop points that is next to each of the some of the second needle drop points in the sewing order, and the second stitch end point being one of the plurality of second needle drop points that is next to the first stitch end point in the sewing order; and creating embroidery data, the embroidery data being data that identifies respective positions of the plurality of first needle drop points and the plurality of second needle drop points, and the sewing order.

7. The computer program product according to claim 6, wherein the positions of the some of the plurality of second needle drop points are respectively changed to be on a virtual line segment in a case where one of the value of the ratio of the length of the first line segment to the length of the second line segment and the difference between the length of the first line segment and the length of the second line segment is equal to or more than the specified threshold value, the virtual line segment being a line segment that connects the first stitch end point and the second stitch end point.

8. The computer program product according to claim 6, wherein a number of the some of the second needle drop points whose positions are changed is equal to or less than one-half of a total number of the plurality of second needle drop points, and the positions of the some of the second needle drop points that are initially set on the second line segment are not adjacent to each other.

9. The computer program product according to claim 6, wherein in accordance with one of the value of the ratio of the length of the first line segment to the length of the second line segment and the difference between the length of the first line segment and the length of the second line segment, a number of the some of the second needle drop points whose positions are changed becomes larger as one of the value of the length ratio and the length difference becomes larger.

10. The computer program product according to claim 6, wherein in accordance with the acquired density, the position of each of the some of the second needle drop points is changed to a position that is closer to the first stitch end point, as the density becomes higher.

* * * * *